US005264756A

United States Patent [19]

Westlund, Jr. et al.

[11] Patent Number: 5,264,756

[45] Date of Patent: Nov. 23, 1993

[54] SMALL VOLUME, HIGH WATTAGE PRESS SEALED LAMP

[75] Inventors: Arnold E. Westlund, Jr., Winchester; Raymond T. Fleming, Lexington, both of Ky.

[73] Assignee: GTE Products Corporation, Danvers, Mass.

[21] Appl. No.: 813,541

[22] Filed: Dec. 26, 1991

[51] Int. Cl.[5] ..... H01K 1/40

[52] U.S. Cl. ..... 313/318; 313/332; 313/580

[58] Field of Search ..... 313/318, 332, 580, 623; 439/605, 611, 612, 619

[56] References Cited

U.S. PATENT DOCUMENTS

| | | | |
|---|---|---|---|
| 3,356,884 | 12/1967 | Decker et al. | 313/332 X |
| 3,673,454 | 6/1972 | Notelteirs | 313/332 |
| 3,721,852 | 3/1973 | Chiola et al. | 313/318 |
| 3,868,528 | 2/1975 | Lake et al. | 313/623 |
| 3,991,337 | 11/1976 | Notelteirs | 313/332 X |
| 4,354,137 | 10/1982 | Martin et al. | 313/623 X |

*Primary Examiner*—Donald J. Yusko
*Assistant Examiner*—Ashok Patel
*Attorney, Agent, or Firm*—William E. Meyer

[57] ABSTRACT

A small volume, high wattage press sealed lamp having envelope, filament, internal leads, seal foils, external leads, and blades is disclosed. The small volume, high wattage press sealed lamp increased conductivity due to a flat faced external lead forming one of the foil welds. The external lead is butt welded to blade stock at ninety degrees forming a highly conductive bond.

6 Claims, 2 Drawing Sheets

SMALL VOLUME, HIGH WATTAGE PRESS SEALED LAMP

TECHNICAL FIELD

The invention relates to electric lamps and particularly to press sealed electric lamps. More particularly the invention is concerned with the lead structure of a press sealed lamp.

BACKGROUND ART

One method of getting more light out of a lamp is to increase the size of the filament and then increase the filament current. The current increase brings the larger filament back up to the proper temperature, so the enlarged filament emits more total light. Unfortunately, the current increase must be born by the existing lead structure. Any points of electrical resistance in the socket, seal and other portions of the lead structure then get hotter. The extra heat in the socket or seal can injure the socket, or shorten the lamp's life. There is then a need to improve the electrical lead structure of press sealed lamps.

In small pin type lamps, the filament is commonly press sealed in a small quartz tube. The filament leads join to molybdenum seal foils that are in turn welded to round nickel or molybdenum external leads. The round external leads are capped with nickel tubes that are then swaged to the external leads near where the leads emerge from the quartz. The rest of the nickel capping tube is then flattened, crushing the round tube and the enclosed round wire into an approximately rectangular blade connector. Typically both external leads are capped, and both nickel tubes are flattened to extend as offset, parallel but not coplanar blades. The side by side blades form a plug connection that may be inserted into a lamp socket.

The flattened tube construction starts to electrically fail at about 350 or 400 watts. The contact area between the external leads and the flattened tubes is too small, and irregular. Local hot spots may form along the external leads. Similarly, the seal foil to external lead weld may have too small a conduction area. The blades can overheat, and the seals can fail. There is then a need for a blade type lead structure for small lamps that has improved conductivity, and one where the improved conductivity is sufficient to withstand 400 watt service.

DISCLOSURE OF THE INVENTION

A small volume, high wattage press sealed lamp capsule may be formed with an envelope defining an internal volume, and a press sealed end. A filament is enclosed in the internal volume, supported and electrically coupled to the internal leads. Seal foils are electrically coupled to the internal leads and sealed to the envelope in the press seal. External leads, at least one of which has an internal end with a flat weld face are aligned with respective seal foils and welded. The external lead additionally has an external end having a flat end face transverse to the length of the external lead, where a blade with an approximately rectangular cross section, and a flat internal end, is butt welded to the flat end face of the external lead.

BEST MODE FOR CARRYING OUT THE INVENTION

Figure 1:
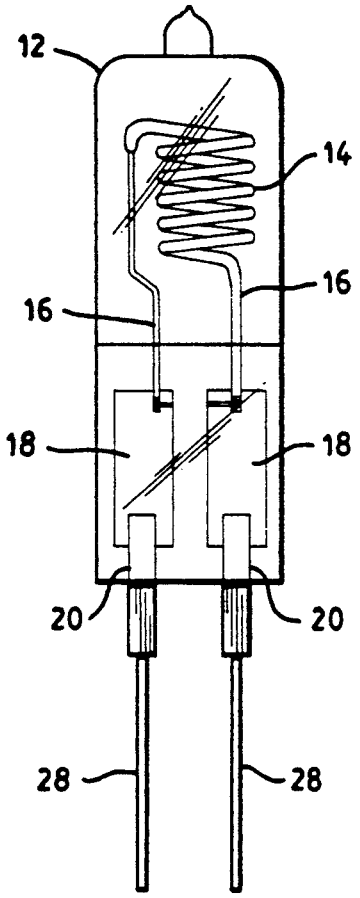
FIG. 1 shows elevational view of a preferred embodiment of a small volume, high wattage press sealed lamp capsule.

FIG. 1 shows a preferred embodiment of a small volume, high wattage press sealed lamp. The small volume, high wattage press sealed lamp is assembled from an envelope 12, a filament 14, internal leads 16, seal foils 18, external leads 20, and blade 28 connectors.

The envelope 12 is formed from a light transmissive material, and is shaped to enclose an internal volume. Positioned along envelope 12 is a press seal. By way of example envelope 12 is shown as a single ended press sealed quartz tube. The top end was tubulated and sealed. The bottom end includes the single ended press seal. The lamp volume may be small, less than two milliliters.

The envelope 12 encloses the filament 14, and the internal leads 16. The filament 14 may be a coiled coil tungsten filament typical of small lamps. The filament 14 is electrically coupled to the internal leads 16. The internal leads 16 are in turn electrically coupled to the seal foils 18. Seal foils are commonly made of molybdenum foil that is welded to the internal leads 16 and the external leads 20. The envelope 12, in the press seal region during manufacture is heated to a plastic state and pressed to enclose and seal with the seal foils 18. The welds and a bit of the internal leads 16 and external leads 20 are also caught in the press sealed envelope 12 material.

The seal foils 18 are also welded to the external leads 20. The preferred external leads 20 each have an internal end 22 with a flat side face 24, and a flat external end 26. The flat side face 24 may be a swaged end of a round wire. The flat side face 24 is preferrably just the broad side of an approximately rectangular wire. The rectangular wire is then wider than it is thick over its length. The preferred flat side face 24 is also serrated 25, or notched several times transversely to the length of the external lead 20. The seal foil 18, and flat side face 24 can then be positioned adjacent each other, with broad, parallel faces abutting. If the flat side face 24 has been serrated 25, the serrations 25 dig into the seal foil 18. The seal foil 18, and flat side face 24 are then welded together, forming a broad area weld.

The opposite end of the external lead 20 has a flat end face 26, extending transversely to the length of the external lead 20. The flat end face 26 is also preferrably approximately rectangular. Again, the flat end face 26 may be formed by swaging the end of a round wire. The preferred embodiment for the external lead 20 is a rectangular wire. The end of the rectangular wire may be cut off transverse to the length of the wire, thereby leaving a transverse, flat end face 26.

Figure 2:
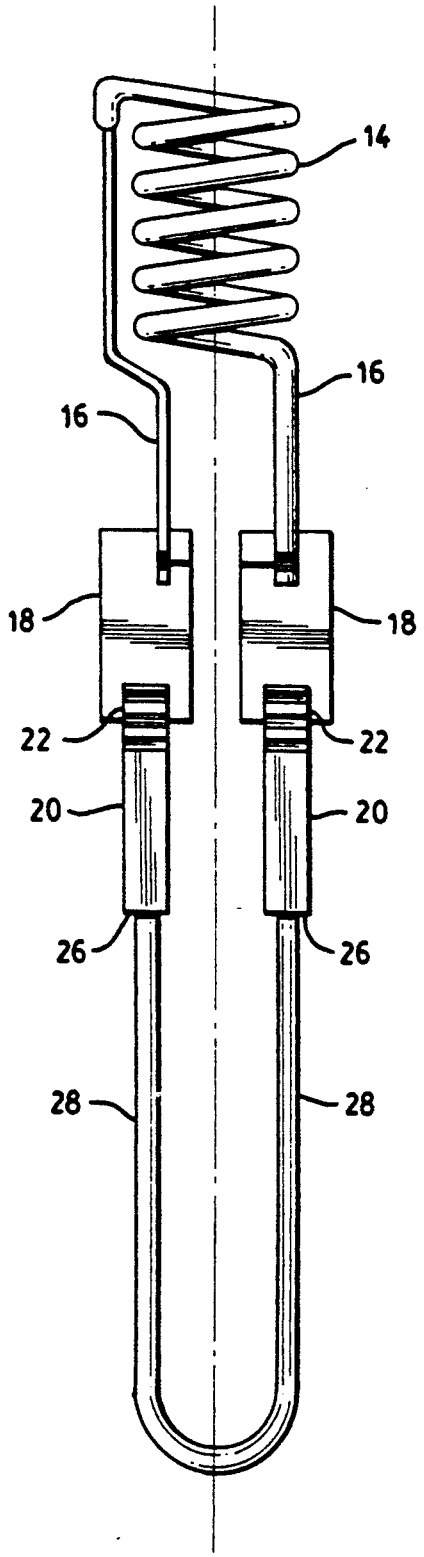
FIG. 2 shows the completed lead assembly during a manufacturing stage.
Figure 3:
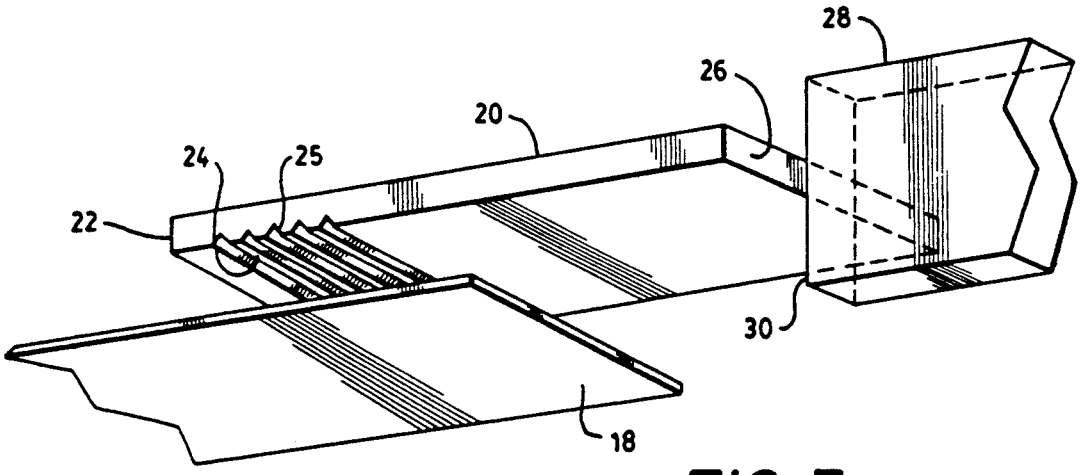
FIG. 3 shows an exploded, perspective view, partially broken away, of the seal foil, external lead, and blade alignments prior to welding.

The external leads 20, along the flat end faces 26 are butt welded to the blades 28. The blades 28 have an approximately rectangular cross section, and a flat weld end 30. The blades 28 have a width and thickness that is appropriate for making a plug type connection. The internal, flat weld end 30 of each blade 28 is then butted against the external flat end face 26 of a respective external lead 20. In the preferred alignment, the external lead 20 and the respective blade 28 are aligned so the respective board sides are at ninety degrees to one another. The external leads 20 and respective blades 28 are then welded. The ninety degree or X type crossing has been found to produce much sounder butt welds. The overlapping edges seem to hold the pieces in alignment during welding. The colder, non-contacting edges seem to steady and guide the molten area where the external lead and blade cross. The molden core material is allowed to wick to the colder edges, thereby filling in the corner areas. A more complete fusing of the two pieces results. FIG. 2 shows the lead assembly during a manufacturing stage, prior to being inserted and press sealed to an envelope 12. FIG. 3 shows an exploded, perspective view, partially broken away, of the seal foil, external lead, and blade alignments prior to welding.

A small volume, high wattage press sealed lamp may be assembled by first forming an envelope 12. A filament 14 and lead assembly is then constructed. The filament 14 is welded to the internal leads 16. A flattened nickel wire or similar elongated nickel stock with a rectangular cross section appropriate for use as plug blades (blade stock), is cut into sections. External leads 20 are formed to have side faces 24, serrations 25, if any, and external, transaxial, flat end faces 26. The external leads 20 are then butt welded to each end of the flattened nickel wire (blade stock). The external leads 20 and blade assembly is then formed into a U shaped piece by bending the blade stock at its middle, in the direction of the narrower thickness. The external leads 20 are thereby brought into a parallel, and perpendicularly offset relation. The legs of the U shaped piece, including the external leads 20 are separated by the width expected for the blades 26 of the final lamp design. The seal foils 18 are positioned flat against the flattened side faces 24 and the two are welded together. The assembly of the filament 14 welded to the internal leads 16 positioned with the external ends of the internal leads adjacent the seal foils 18, and the internal leads 16 are then welded to the seal foils 18. The filament and lead assembly is now complete.

The external and the internal leads 16 are welded to seal foils 18. External leads 20 are formed to have flat side faces 24, and external, transaxial, flat end faces 26. The flat side faces 24 are positioned flat against the side of the seal foils 18 and welded together.

A flattened nickel wire, or similar elongated nickel stock with an approximately rectangular cross section (wider than thick) is cut into sections and formed into a U shape piece. The legs of the U shaped piece are separated by the width expected for the blades 28 of the final lamp design, which is the same as the separation between the external leads 20. The flat faces of the legs then face one another. The tips of the U shaped piece are then butted against the flat end faces 26 of the external leads 20, and the external leads 20 and U shaped pieces are then welded together. The filament and lead assembly is now complete.

Figure 4:
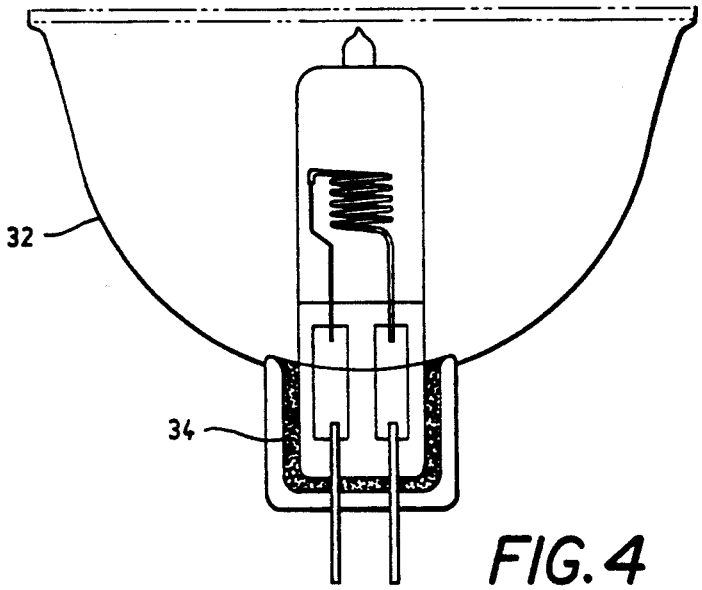
FIG. 4 shows an elevational view of a preferred embodiment of a small volume, high wattage press sealed lamp capsule cemented in a reflector, with the reflector in cross section.

The filament is inserted into the envelope 12, and the envelope 12 is sealed to the seal foils 18 by standard press sealing methods. The bottom of the U shaped piece is then cut off leaving the straight legs projecting as the blade 28 connectors. The lamp capsule is now complete and may be further housed in a reflector 32 or similar structure. In one embodiment, the completed lamp capsule was used as the light source in a small reflector lamp. The press seal region was cemented to the reflector 32 with the cement 34 enclosing the external lead to blade welds. The blades were otherwise exposed through the cement for plug connection of the lamp. FIG. 4 an shows elevational view of a preferred embodiment of a small volume, high wattage press sealed lamp capsule cemented in a reflector 32, with the reflector 32 in cross section.

In a working example some of the dimensions were approximately as follows: The envelope was a single ended, press sealed quartz tube having an overall length of about 3.0 centimeters, with a diameter of about 1.0 centimeters. The filament was a coiled, coiled coil axially aligned and supported by two internal leads. The internal leads were welded to two side by side, molybdenum foils each about 0.9 centimeter long and 2.8 millimeters wide. The external ends of the seal foils were face to face welded to flat side ends of the external leads. The flat side faces had been swaged with transverse serrations separated by about 0.5 millimeters. The external leads were flattened wire pieces about 6.0 millimeters long, 1.0 millimeter wide and 0.5 millimeter thick. The external ends of the external leads were butt welded at ninety degrees to blade connectors. The blade connectors were formed from flat metal nickel stock with a width of 2.0 millimeters, and a thickness of about 0.7 millimeter. The capsule was then positioned in a 5.0 centimeter diameter reflector, with the press seal, and external lead areas cemented in a through passage formed in the reflector. The blades 28 extended beyond the cement to the read exterior for plug connection. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

I claim:

1. A small volume, high wattage press sealed lamp comprising:

a) an envelope defining an internal volume, and having a press sealed end, b) a filament, enclosed in the internal volume, c) internal leads, electrically coupled to the internal leads and sealed to the envelope in the press seal, d) seal foils, electrically coupled to the internal leads and sealed to the envelope in the press seal, e) external leads, at least one of which has an internal end with a flat side face coplanarly aligned with a respective seal foil and welded to the respective seal foil, and has an external end having a flat end face transverse to the length of the external lead, and f) blades, at least one of which has an approximately rectangular cross section defining two major side surfaces and two minor side surfaces, and a flat internal end, butt welded to the flat end face of a respective external lead.

2. The lamp capsule in claim 1, wherein the flat side face of the external lead is serrated.

3. The lamp capsule in claim 1, wherein the external lead with the flat side face is welded to one of the blades with the flat side face positioned at ninety degrees to a major side face of that respective blade.

4. The lamp capsule in claim 1, wherein the blades are positioned to lie side by side, in a substantially parallel relation.

5. The lamp capsule in claim 4, wherein the flat side face of the external lead is serrated.

6. The lamp capsule in claim 4, wherein the external lead with the flat side face is welded to one of the blades with the flat side face positioned at ninety degrees to a major side face of that respective blade.

* * * * *